United States Patent [19]

Butterfield et al.

[11] Patent Number: 4,862,845

[45] Date of Patent: Sep. 5, 1989

[54] VARIABLE CAMSHAFT TIMING SYSTEM

[75] Inventors: Roger P. Butterfield, Interlaken; Franklin R. Smith, Slaterville Springs, both of N.Y.

[73] Assignee: Borg-Warner Transmission and Engine Components Corporation, Ithaca, N.Y.

[21] Appl. No.: 192,079

[22] Filed: May 10, 1988

[51] Int. Cl.[4] ..... F01L 1/34

[52] U.S. Cl. ..... 123/90.15; 123/90.31

[58] Field of Search ..... 123/90.15, 90.27, 90.31

[56] References Cited

U.S. PATENT DOCUMENTS

| | | | |
|---|---|---|---|
| 3,441,009 | 4/1969 | Rafanelli | 123/90.15 |
| 3,683,875 | 8/1972 | Chadwick | 123/90.15 |
| 4,685,429 | 8/1987 | Oyaizu | 123/90.15 |
| 4,716,864 | 1/1988 | Binder | 123/90.31 |
| 4,726,331 | 2/1988 | Oyaizu | 123/90.31 |
| 4,744,338 | 5/1988 | Sapienza, IV | 123/90.15 |

FOREIGN PATENT DOCUMENTS

| | | | |
|---|---|---|---|
| 3713911 | 10/1987 | Fed. Rep. of Germany | 123/90.31 |
| 0240808 | 11/1985 | Japan | 123/90.15 |
| 0651109 | 8/1985 | Switzerland | 123/90.31 |

*Primary Examiner*—Charles J. Myhre
*Assistant Examiner*—Weilun Lo
*Attorney, Agent, or Firm*—Robert L. Zieg; James J. Jennings; James A. Geppert

[57] ABSTRACT

A phase shift device utilized for the camshaft sprockets in a chain control device for an engine having separate camshafts for intake and exhaust valves in an internal combustion engine. A device supporting one or a pair of idler sprockets is shiftable, either pivotally or longitudinally to vary the chain path between a driving and a driven camshaft sprocket in such a way as to vary the phase of the driven sprocket relative to the driving sprocket. This device comprises a bracket which carries at least one idler sprocket and is either pivotally or longitudinally shiftable to vary the phase thus facilitating proper chain control.

31 Claims, 4 Drawing Sheets

VARIABLE CAMSHAFT TIMING SYSTEM

BACKGROUND OF THE INVENTION

The present invention relates to a phase shift mechanism for changing the phasing of an intake camshaft. In the last twenty years, automotive engineers and engine designers have worked primarily in the area of reduction of emission levels and fuel economy. Those in the art are aware that certain timing modifications between the engine intake and exhaust valves can reduce certain undesirable components in the engine exhaust.

Also, modern engine design has placed particular emphasis on improvement of the power output of the engine in view of the smaller engine displacement in today's automobiles. To enhance the power output, smaller engines are now more frequently equipped with turbochargers, intercoolers, multivalve heads for each cylinder and variable intake systems.

Variable valve timing is well known to the automotive engineer, and mechanisms of various configurations have been proposed and tested. The advantage of being able to vary the phasing of the intake camshaft relative to the engine crankshaft is well documented in numerous technical writings, however, the mechanisms to achieve this phasing have been complex and very expensive to mass produce. The present invention has been designed to overcome these disadvantages.

SUMMARY OF THE INVENTION

The present invention relates to a novel adjustable valve timing arrangement utilizing a single adjustable bracket supporting idler sprockets and chain control devices. Variation of the phasing of the intake cam is accomplished by changing the chain path between the intake or driven sprocket and the exhaust or driving sprocket on the intake and exhaust camshafts, respectively. The bracket position may be altered rotationally or longitudinally to change the chain path.

The present invention also relates to a novel adjustable valve timing arrangement wherein chain control devices, such as tensioners and snubbers, can be integrated into the bracket design. All chain paths can have chain control devices as required.

The present invention further relates to a novel adjustable valve timing arrangement wherein an adjustable bracket carries a pair of idler sprockets, such that proper placement of the sprockets allows both idlers to move at the same rate over the entire actuation range without the chain going slack.

Further objects are to provide a construction of maximum simplicity, efficiency, economy and ease of assembly and operation, and such further objects, advantages and capabilities as will later more fully appear and are inherently possessed thereby.

DESCRIPTION OF THE INVENTION

Figure 1:
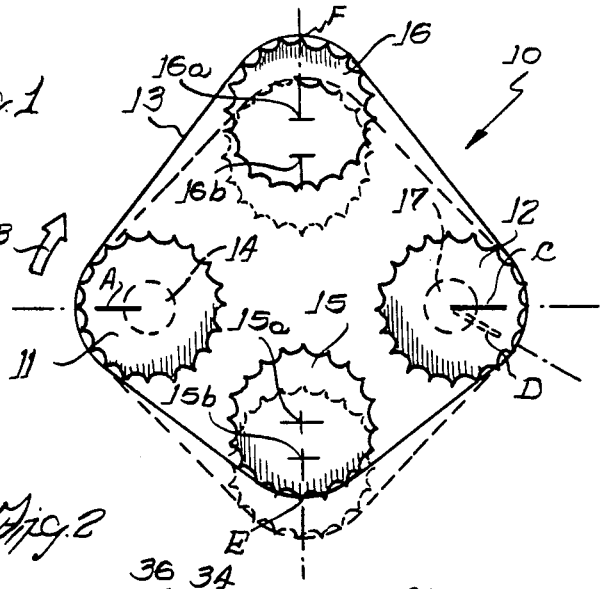
FIG. 1 is an end view of a diagramatic showing of the variable camshaft timing system.

Referring more particularly to the disclosure in the drawings wherein are shown illustrative embodiments of the present invention, FIG. 1 illustrates the method used to vary the phasing of the intake cam relative to the engine crankshaft by providing a chain control device 10 altering the path of a timing chain 13 between the exhaust or driving sprocket 11 and the intake or driven sprocket 12. The intake sprocket 12 on an intake camshaft 17 is driven by the exhaust sprocket 11 on an exhaust camshaft 14, which in turn is being driven by a crankshaft sprocket and timing chain (not shown) at one-half of the crankshaft speed for a four cycle engine. The exhaust sprocket 11 has a timing mark at position A. Idler sprockets 15 and 16 are also engaged by the chain 13 moving in the direction of arrow B.

When the idler sprocket 15 is in position 15*a*, then the timing mark on sprocket 12 is in position C and the other idler sprocket is located in position 16*a* to take up chain slack at installation. However, if the idler sprocket 15 is moved to position 15*b* and the timing mark on sprocket 11 remains at position A, then the timing mark on sprocket 12 will advance to position D, thus changing the timing of sprocket 12 relative to sprocket 11. Since the exhaust camshaft 14 is in a fixed position relative to the crankshaft, the intake camshaft 17 and sprocket 12 phasing is changed relative to the crankshaft. In addition, since the crankshaft sprocket turns twice as fast at the intake sprocket, a 1° change at the intake cam equates to a 2° change at the crankshaft. The idler sprocket 16 also must move to position 16*b* to allow the chain 13 to follow the idler sprocket 15. Following the chain path clockwise, ideally the increase in chain length CDEA when idler sprocket 15 is moved from position 15*a* to position 15*b* is equal to the decrease in chain length AFC when idler sprocket 16 is moved from position 16*a* to 16*b*. This will prevent the chain from going slack.

Figure 2:
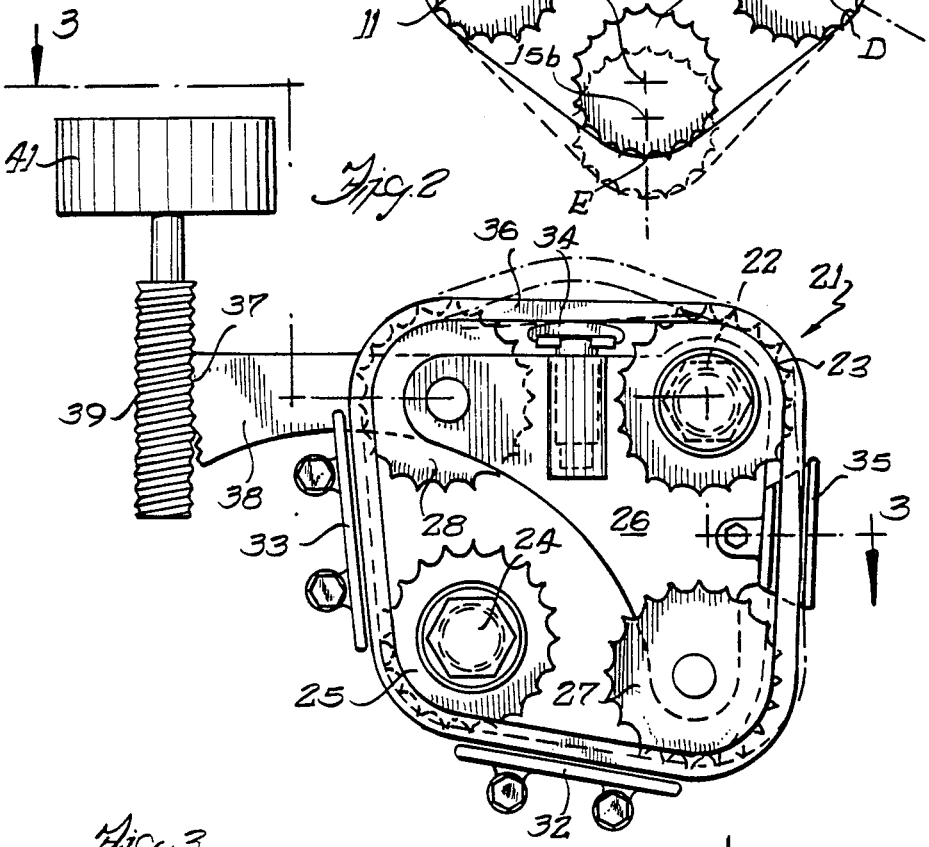
FIG. 2 is an end view of a first embodiment of a variable camshaft timing system according to the present invention.
Figure 3:
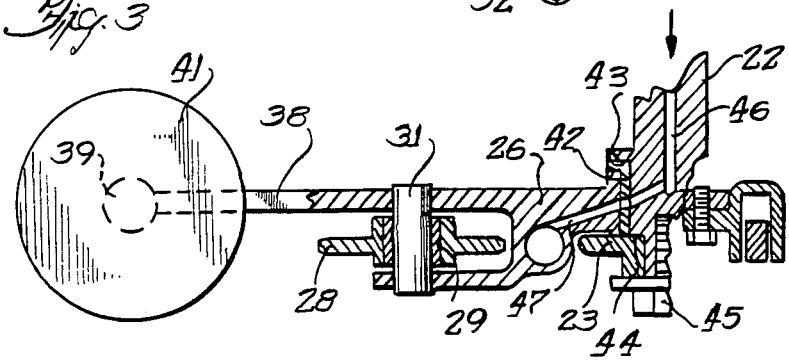
FIG. 3 is a cross sectional view of the device taken on the irregular line 3—3 of FIG. 2.

There are numerous configurations that can accomplish the positioning of the idlers in order to provide an active variable cam timing device. One approach is illustrated in FIGS. 2 and 3 where the device 21 includes an intake sprocket 23 mounted on an intake camshaft 22, an exhaust sprocket 25 on exhaust camshaft 24, and a pair of idler sprockets 27 and 28 mounted on a generally L-shaped bracket 26 that is pivotally mounted on the intake camshaft 22. Each idler is supported by a bearing 29 that rotates on a stationary shaft 31 (FIG. 3) that is mounted in the bracket 26.

Careful positioning of the idlers in relation to the exhaust sprocket 25 and intake sprocket 23 provides several advantages. This device 21 can vary the phasing of the intake camshaft 22 more than 30° relative to the exhaust camshaft 24 (which equates to 60° of crankshaft travel) without changing the chain length or allowing the chain to go slack. It is the proper positioning of the idler sprockets that also allows the idlers to be mounted on a single bracket and actuated at the same rate instead of having to move the idlers independently at different rates. Another benefit is that the theoretical chain path between idler sprocket 27 and exhaust sprocket 25 and between exhaust sprocket 25 and idler sprocket 28 have very small deviations from a straight line over the full range of actuation, allowing the use of stationary chain control devices 32,33, if required.

In the present instance, chain guides or snubbers 32 and 33 are positioned as shown, and a chain tensioner 34 is located on the bracket 26 between idler sprocket 28 and intake sprocket 23. Also chain control devices, such as snubber 35 can be mounted on the pivoting bracket, so that the snubber 35 and tensioner 34 can maintain their relative position to the path of timing chain 36 as the bracket pivots. The designer has the option of chain control devices along all chain strands between sprockets depending on the need. The combination of the tensioner and snubber on the bracket reduces components and packaging space required while maintaining chain control.

Actuation of the bracket 26 is accomplished by means of a gear sector 37 machined as an integral part of the bracket on the edge of one arm 38 (see FIG. 3). Obviously, this gear sector may be made separately and attached to the bracket. A worm gear 39 driven by a reversible motor 41 engages the gear sector 37. Using a right hand lead on the worm, rotation of the worm clockwise, when viewed from behind the motor causes the bracket to rotate clockwise. Using proper control methods, this device is variable in infinitely small increments across the entire operating range. The bracket could also be operated by other methods, such as a hydraulic/pneumatic piston and linkage.

As seen in FIG. 3, the bracket 26 is mounted directly on the intake camshaft 22 supported by a sleeve bearing 42. The bracket is captured axially between a shoulder 43 on the camshaft and the intake sprocket 23; the sprocket in turn being clamped axially against a shoulder 44 on the shaft with a bolt 45 that is threaded into the shaft end. The sprocket is located rotationally on the intake camshaft 22 by a suitable key. Lubrication is fed through the center of the camshaft to the bracket support bearing 42 through a lube hole 46 in the camshaft. Also a lube hole 47 cross drilled in the bracket 26 provides pressurized oil to the chain tensioner 34. The bracket 26 can also be mounted on a stationary hollow post that is coaxial with the intake shaft.

Figure 4:
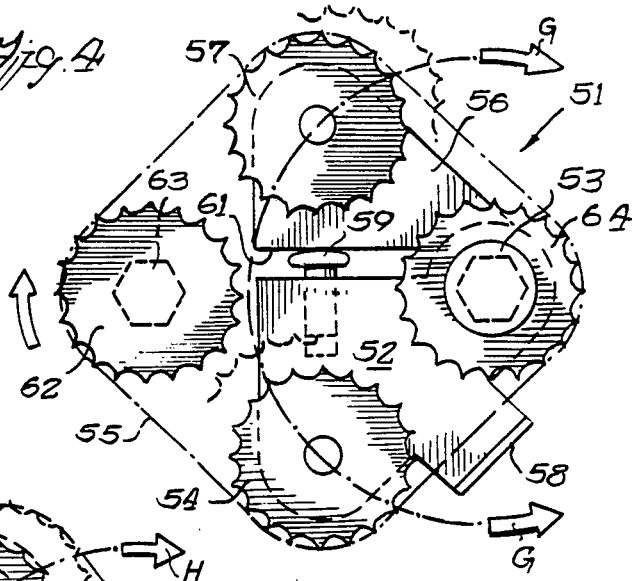
FIG. 4 is a view similar to FIG. 2 of a second embodiment of the invention.

FIG. 4 discloses a device 51 having a alternate construction of pivoting bracket formed in two parts. The bracket includes a primary bracket 52 pivotally mounted on the intake camshaft 53 and carrying an idler sprocket 54 for the tight side of timing chain 55. A secondary bracket 56 is also pivotally mounted on camshaft 53 and carries an idler sprocket 57 for the slack side of the chain. The primary bracket 52 includes a chain snubber 58 and a tensioner 59, which may be hydraulically or spring-actuated, the tensioner engaging a surface 61 of the secondary bracket 56 to urge the brackets apart around the axis of camshaft 53. An exhaust sprocket 62 on camshaft 63 and an intake sprocket 64 on camshaft 53 completes the device. Actuation of the primary bracket 52 in the direction of arrows G may be accomplished by a worm drive, such as shown in FIGS. 2 and 3, a rack and pinion or a hydraulic piston and linkage.

Figure 5:
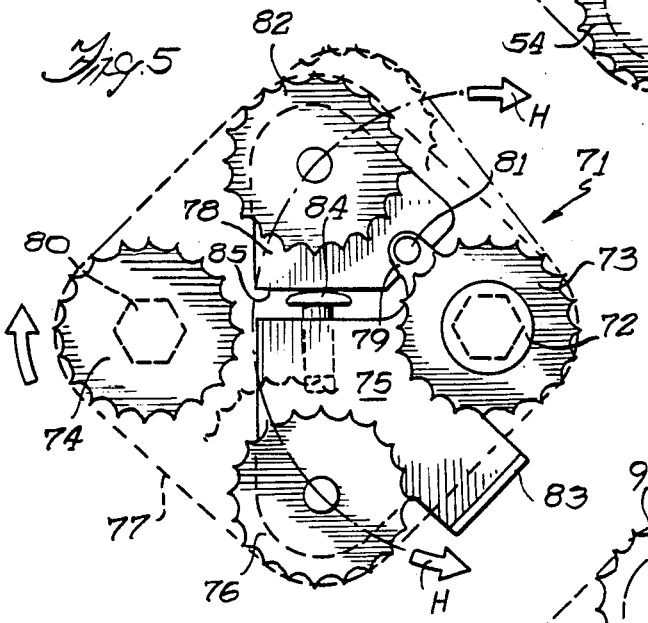
FIG. 5 is a view similar to FIG. 2 of a third embodiment of the invention.

FIG. 5 illustrates a device 71 similar to FIG. 4 having an intake sprocket 73 on intake camshaft 72, an exhaust sprocket 74 on exhaust camshaft 80, a primary bracket 75 pivotally mounted on camshaft 72 and carrying an idler sprocket 76 for the tight side of a chain 77, and a secondary bracket 78 pivotally mounted by a pin 81 on a small arm 79 projecting from the primary bracket and carrying an idler sprocket 82 for the slack side of the chain. Again, the primary bracket 75 has a chain snubber 83 and a tensioner 84 therein acting against a surface 85 of the secondary bracket 78. The primary bracket 75 is pivotally adjustable in the direction of arrows H about the axis of camshaft 72.

Figure 6:
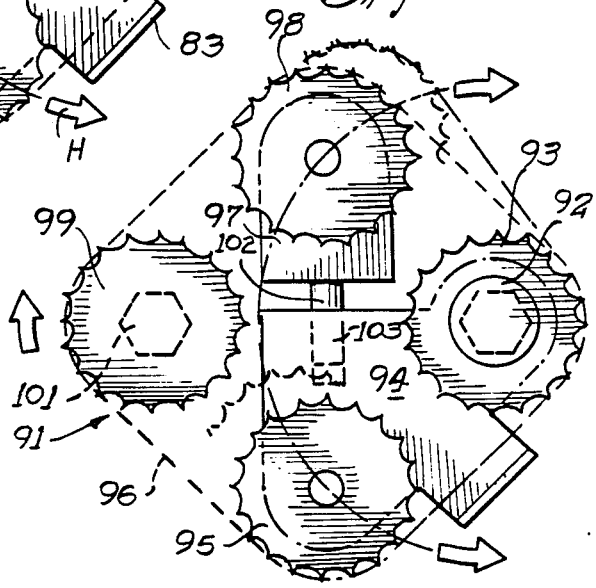
FIG. 6 is a view similar to FIG. 2 of a fourth embodiment of the invention.

Another embodiment of pivotally adjustable bracket device 91 is shown in FIG. 6 wherein the bracket 94 is pivotally mounted on the intake camshaft 92 having the intake sprocket 93 thereon. The bracket carries an idler sprocket 95 for the tight side of chain 96 and a bracket tensioner 97 carrying idler sprocket 98 for the slack side of the chain. An exhaust sprocket 99 is mounted on the exhaust camshaft 101 to be driven by the engine crankshaft (not shown). The tensioner 97 includes a reduced diameter piston 102 received in a cylinder 103 formed in the bracket 94 for hydraulic actuation.

Figure 7:
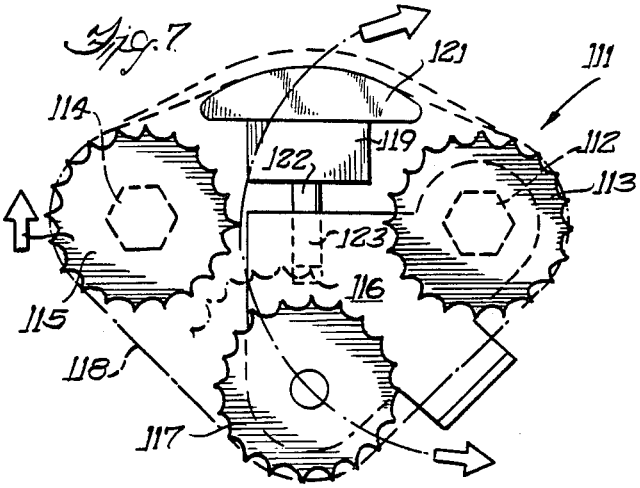
FIG. 7 is a view similar to FIG. 2 of a fifth embodiment.

FIG. 7 discloses a further device 111 having an intake sprocket 113 on intake camshaft 112, an exhaust sprocket 115 on exhaust camshaft 114, and a bracket 116 pivotally mounted on camshaft 112 and carrying an idler sprocket 117 for the tight side of chain 118. Instead of a second idler sprocket, a chain tensioner 119 having a chain engaging enlarged head 121 of a low friction material is urged into contact with the slack side of the chain 118. The tensioner includes a reduced diameter piston 122 on the end opposite the enlarged head 121 received in a cylinder or recess 123 in the bracket 116 for hydraulic or spring actuation. Although the bracket is shown in each of these embodiments as pivoting on the intake camshaft, the bracket obviously could be pivotally mounted on the exhaust camshaft as well.

Figure 8:
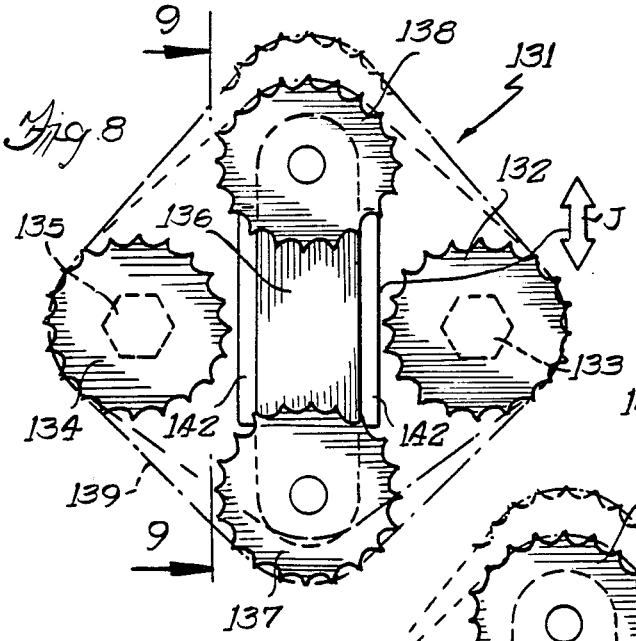
FIG. 8 is a view similar to FIG. 2 of a sixth embodiment.
Figure 9:
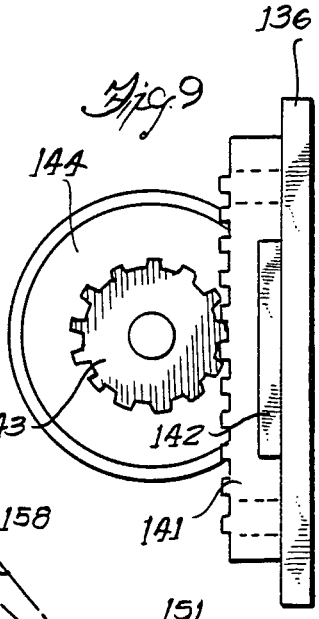
FIG. 9 is a cross sectional view taken on line 9—9 of FIG. 8 with the sprockets omitted with a diagramatic showing of an alternate actuating arrangement for the bracket.

FIGS. 8 through 13 disclose an alternate family of devices utilizing a single linear sliding bracket to move the idler sprockets and chain control devices. FIGS. 8 and 9 disclose a device 131 having an intake sprocket 132 on camshaft 133, an exhaust sprocket 134 on exhaust camshaft 135, and an elongated linear sliding bracket 136 carrying a tight side idler sprocket 137 at one end and a slack side idler sprocket 138 on the opposite end for a timing chain 139. The bracket is arranged for linear motion in direction of the arrows J. FIG. 9 shows a diagramatic example of motive power for the bracket consisting of a rack 141 secured to the rearward surface of the elongated bracket 136, the rack by guided in suitable support means 142, and a pinion 143 engaging the teeth of the rack and rotated in either direction by a suitable motor 144.

Figure 10:
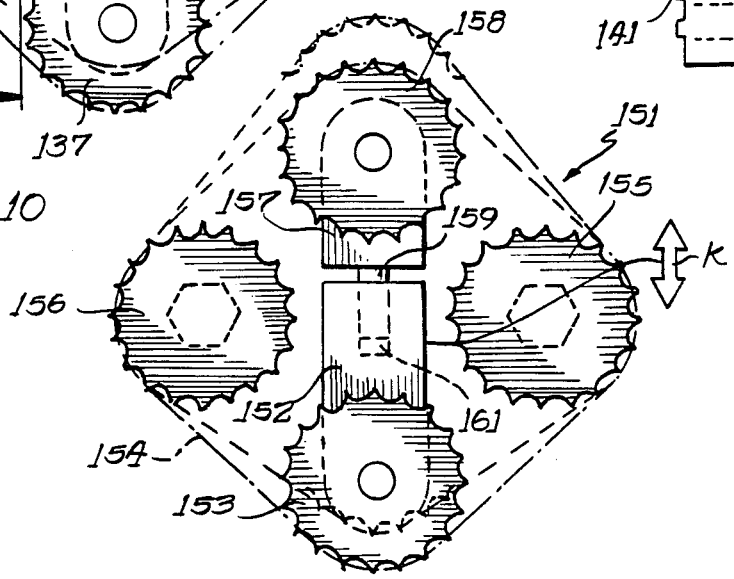
FIG. 10 is a view similar to FIG. 2 of seventh embodiment.

FIG. 10 discloses a device 151 similar to that of FIG. 8 wherein a linear sliding bracket 152 movable in the direction of arrows K carries an idler sprocket 153 for the tight side of timing chain 154 riding on the intake sprocket 155 and the exhaust sprocket 156. The opposite end 157 of the bracket carries a slack side idler sprocket 158 acting as a chain tensioner. This end 157 is separate from the remainder of the bracket and is provided with a reduced diameter piston 159 received in a cylinder 161 in the bracket 152 for hydraulic/pneumatic or spring actuation for the slack side of the chain.

Figure 11:
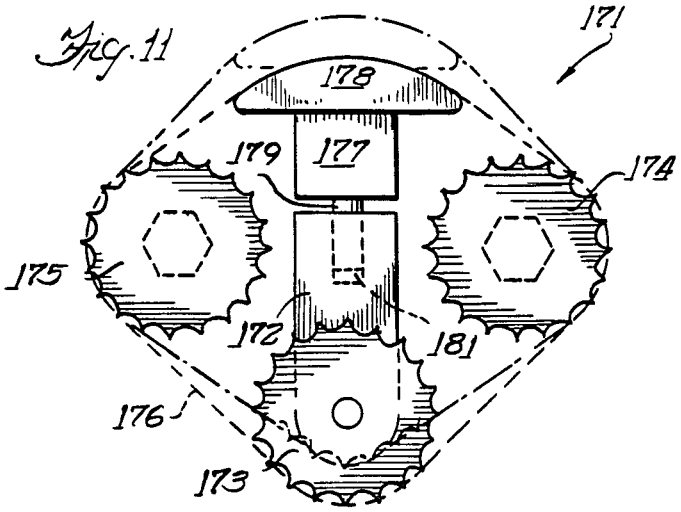
FIG. 11 is a view similar to FIG. 2 of an eighth embodiment.

A device 171 is shown in FIG. 11 which is similar to that of FIG. 10 except that the bracket 172 carries only the tight side idler sprocket 173 cooperating with the intake and exhaust sprockets 174 and 175, respectively, and the chain 176. The separate bracket part 177 providing a slack side tensioner has an enlarged head 178 of a low friction material with a curved surface contacting the inner surface of the chain 176. Here again, the tensioner has a reduced dimension piston 179 opposite the head 178 received in a cylinder 181 formed in the bracket.

Figure 12:
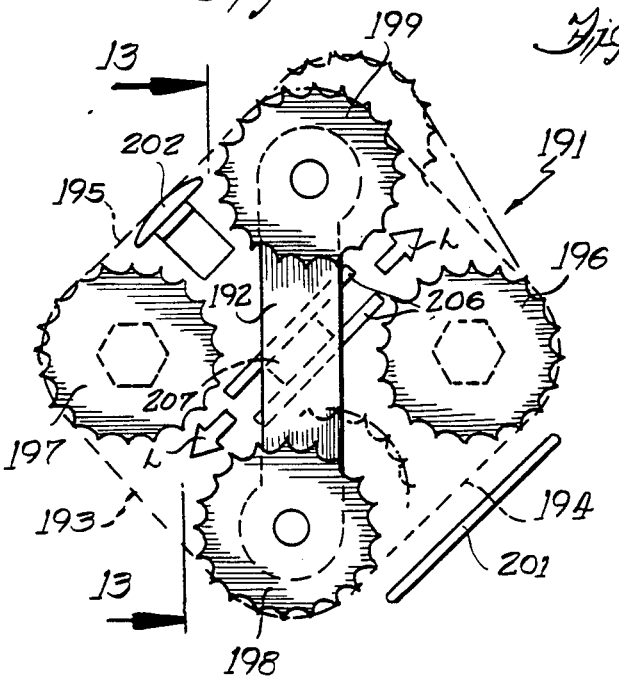
FIG. 12 is a view similar to FIG. 2 of a ninth embodiment.
Figure 13:
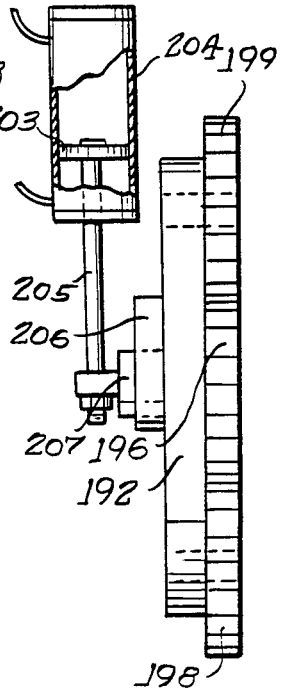
FIG. 13 is a cross sectional view taken on line 13—13 of FIG. 12 diagramatically showing a third form of bracket actuating device.

FIGS. 12 and 13 disclose a final device 191 for a linear sliding support bracket 192 wherein the bracket slides in the direction of arrows L, which is parallel to the opposite strands 194,195 of the timing chain 193. The chain rides on the intake sprocket 196, the exhaust sprocket 197 and a pair of idler sprockets 198,199 rotatably mounted adjacent the opposite ends of the bracket. A chain guide or snubber 201 for strand 194 and a chain tensioner 202 for strand 195 are stationary on the engine block or head (not shown). As seen diagramatically in FIG. 13, a piston 203 and cylinder 204 are appropriately mounted with the piston rod 205 being secured at its free end to a block 207 on the rear surface of the bracket 192 acting with guides 206,206 to move the bracket in the direction of arrows L.

The various devices shown and described above have the following novel features:

1. The proper placement of the idler sprockets allows both idlers to move at the same rate over the entire actuation range without the chain going slack.

2. Allowing both idlers to move at the same rate over the actuation range allows the idlers to be mounted on the same actuating bracket by eliminating the need to actuate the idlers independently at varying rates.

3. All chain paths can have chain control devices if necessary.

4. Chain control devices, such as snubbers and tensioners can be integrated into the bracket design.

5. Chain control devices can also be mounted on a stationary surface along the chain paths that remain substantially constant during actuation.

6. The mounting bracket can have either pivoting or linear sliding movement for actuation of the idlers, and the brackets can be actuated by a variety of actuating means.

We claim:

1. A variable camshaft timing system for an internal combustion engine having intake and exhaust valves and a camshaft for each of said intake and exhaust valves, an intake sprocket and an exhaust sprocket keyed to their respective camshaft, only one of said camshafts being directly driven by an engine crankshaft, and a timing chain engaging both sprockets, the improvement comprising a single bracket carrying at least one idler sprocket engaging said timing chain, said bracket being mounted for movement to alter the timing relationship between said intake and exhaust sprockets.

2. A variable camshaft timing system for an internal combustion engine having intake and exhaust valves and a camshaft for each of said intake and exhaust valves, an intake sprocket and an exhaust sprocket keyed to their respective camshafts, one camshaft being driven by an engine crankshaft, and a timing chain engaging both sprockets, the improvement comprising a single bracket having a pair of spaced idler sprockets engaging said chain between said intake and exhaust sprockets to form a generally rhomboidal path for the chain, said bracket being adjustable to alter the timing relationship between said intake and exhaust sprockets.

3. A variable camshaft timing system as set forth in claim 1, wherein said bracket includes an idler sprocket and a spaced chain tensioner.

4. A variable camshaft timing system as set forth in claim 2, wherein chain control devices can be integrated into said bracket design.

5. A variable camshaft timing system as set forth in claim 1, wherein a timing mark on the exhaust sprocket remains stationary while the timing setting of the intake sprocket will change upon movement of said bracket and idler sprocket.

6. A variable camshaft timing system for an internal combustion engine having intake and exhaust valves and a camshaft for each of said intake and exhaust valves, an intake sprocket and an exhaust sprocket keyed to their respective camshafts, one camshaft being driven by an engine crankshaft, and a timing chain engaging both sprockets, the improvement comprising a single L-shaped bracket pivotally mounted on one of said camshafts and having a pair of spaced idler sprockets rotatably mounted on the legs of said bracket, and means for adjustably moving said bracket to alter the positions of said idler sprockets and the timing relationship batten said intake and exhaust sprockets.

7. A variable camshaft timing system as set forth in claim 6, in which said bracket includes a chain tensioner and at least one snubber for the chain.

8. A variable camshaft timing system as set forth in claim 6, wherein said bracket has a centrally located pivotal mounting cooperating with said camshaft.

9. A variable camshaft timing system for an internal combustion engine having intake and exhaust valves and a camshaft for each of said intake and exhaust valves, an intake sprocket and an exhaust sprocket keyed to their respective camshafts, one camshaft being driven by an engine crankshaft, and a timing chain engaging both sprockets, the improvement comprising a primary bracket carrying an idler sprocket and a secondary bracket carrying a second idler sprocket, at least said primary bracket being pivotally mounted on a camshaft, and a tensioner in one bracket urging said brackets apart, said brackets being adjustable to alter the timing relationship between said intake and exhaust sprockets.

10. A variable camshaft timing system as set forth in claim 9, wherein both brackets are pivotally mounted on the same camshaft.

11. A variable camshaft timing system as set forth in claim 9, wherein said secondary bracket is pivotally mounted on said primary bracket, and said tensioner is carried by said primary bracket to urge said brackets apart.

12. A variable camshaft timing system as set forth in claim 9, wherein said secondary bracket is yieldably urged away from said primary bracket.

13. A variable camshaft timing system as set forth in claim 12, wherein said secondary bracket has a piston opposite its idler sprocket received in a cylinder formed in said primary bracket.

14. A variable camshaft timing system for an internal combustion engine having intake and exhaust valves and a camshaft for each of said intake and exhaust valves, an intake sprocket and an exhaust sprocket keyed to their respective camshafts, one camshaft being driven by an engine crankshaft, and a timing chain engaging both sprockets, the improvement comprising a bracket pivotally mounted on a camshaft and carrying an idler sprocket, and a chain tensioner yieldably urged away from and carried by said bracket to engage the chain opposite to said idler sprocket, said bracket being adjustable to alter the timing relationship between said intake and exhaust sprockets.

15. A variable camshaft timing system as set forth in claim 14, in which said tensioner has an enlarged head with a curved outer surface engaging the chain.

16. A variable camshaft timing system as set forth in claim 1, wherein said bracket is an elongated member having a longitudinal axis and carries an idler sprocket at each end, and means to move said bracket in a linear direction parallel to said longitudinal axis.

17. A variable camshaft timing device a set forth in claim 16, wherein said bracket is formed of two parts longitudinally yieldably urged apart.

18. A variable camshaft timing system as set forth in claim 17, wherein one portion of the bracket provides a chain tensioner.

19. A variable camshaft timing system as set forth in claim 1, wherein said bracket is elongated with a longitudinal axis and mounted for linear motion in the direction of said axis, said bracket carrying an idler sprocket at one end and a chain tensioner at the opposite end, said tensioner having an enlarged head with a curved surface engaging said chain.

20. A variable camshaft timing system as set forth in claim 19, wherein said tensioner is yieldably urged away from the idler sprocket in the longitudinal direction.

21. A variable camshaft timing system as set forth in claim 16, wherein said bracket is mounted for linear movement in a direction other than parallel to the longitudinal axis of the bracket.

22. A variable camshaft timing system as set forth in claim 21, wherein the path of the chain has a rhomboid shape and the path of travel of said bracket is parallel to a pair of opposed strands of the chain.

23. A variable camshaft timing system as set forth in claim 21, wherein chain control means are mounted on the stationary engine surface.

24. A method of adjusting the timing of a pair of camshafts for an internal combustion engine wherein each camshaft has a sprocket and a timing chain engaging said sprockets to provide a camshaft-to-camshaft drive, the method comprising providing a bracket carrying at least one idler sprocket engaging said chain, and shifting said bracket relative to one camshaft to alter the chain path and angular position of the camshaft sprockets relative to each other.

25. A method as set forth in claim 24, wherein said method includes the step of pivoting said bracket about the axis of one of the camshafts.

26. A method as set forth in claim 25, wherein said bracket includes a pair of spaced idler sprockets which are shifted at the same rate over the actuation range.

27. A method as set forth in claim 25, including providing means associated with said bracket to control the tension of said chain.

28. A method as set forth in claim 24, wherein said method includes the step of shifting said bracket along a linear path of movement.

29. A method as set forth in claim 28, wherein said bracket carries a pair of idler sprockets at each end thereof.

30. A method of adjusting the timing of a pair of camshafts for an internal combustion engine wherein each camshaft has a sprocket and a timing chain engaging said sprockets, the method comprising providing a bracket carrying an idler sprocket at each end engaging said chain, and shifting said bracket along a linear path of movement relative to one camshaft to alter the chain path and angular position of the camshaft sprockets relative to each other, said bracket being shifted along a path perpendicular to a line intersecting the axes of said camshafts.

31. A method as set forth in claim 29, in which said bracket is shifted along a path parallel to a pair of opposite strands of said chain.

* * * * *